United States Patent [19]

Wahle et al.

[11] 4,301,816

[45] Nov. 24, 1981

[54] METHOD OF MAKING ROD-SHAPED SMOKERS' PRODUCTS WITH MULTIPLEX FILTER MOUTHPIECES

[75] Inventors: Günter Wahle, Reinbek; Heinz Greve; Herbert Berlin, both of Hamburg, all of Fed. Rep. of Germany

[73] Assignee: Hauni-Werke Körber & Co. KG, Hamburg, Fed. Rep. of Germany

[21] Appl. No.: 5,710

[22] Filed: Jan. 23, 1979

[30] Foreign Application Priority Data

Feb. 6, 1978 [DE] Fed. Rep. of Germany ..... 2804991

[51] Int. Cl.[3] ..... A24D 1/04; A24D 3/00

[52] U.S. Cl. ..... 131/88; 131/360; 131/331

[58] Field of Search ..... 131/10 A, 10 R, 10.7, 131/10.9, 23 R, 21 R; 219/384

[56] References Cited

U.S. PATENT DOCUMENTS

| | | | |
|---|---|---|---|
| 2,740,409 | 4/1956 | Korber | 131/10.7 |
| 3,384,094 | 5/1968 | Molins | 131/10.7 X |
| 3,396,733 | 8/1968 | Allseits et al. | 131/10.7 X |
| 3,658,069 | 4/1972 | Wise | 131/10.7 |
| 3,701,353 | 10/1972 | Pasquine et al. | 131/23 R |
| 4,082,098 | 4/1978 | Owens, Jr. | 131/10 A X |
| 4,090,826 | 5/1978 | Hinzmann | 131/23 R |
| 4,121,595 | 10/1978 | Heitman et al. | 131/21 R |

FOREIGN PATENT DOCUMENTS

| | | | |
|---|---|---|---|
| 2315012 | 10/1973 | Fed. Rep. of Germany | 131/10.9 |

*Primary Examiner*—Stephen C. Pellegrino
*Attorney, Agent, or Firm*—Peter K. Kontler

[57] ABSTRACT

Filter cigarettes with multiplex filter mouthpieces wherein at least one filtering element constitutes an unwrapped filter plug having a reinforced porous peripheral layer are produced in a machine which is equipped with a perforating device for tubular envelopes connecting the mouthpieces to the respective plain cigarettes, or with a device for making holes in the web of wrapping material which is subdivided into uniting bands. The holes are provided in those portions of tubular envelopes which surround the reinforced porous peripheral layers. Filtering elements which constitute unwrapped filter plugs may be disposed at the free ends of the mouthpieces or adjacent to the plain cigarettes.

14 Claims, 4 Drawing Figures

METHOD OF MAKING ROD-SHAPED SMOKERS' PRODUCTS WITH MULTIPLEX FILTER MOUTHPIECES

BACKGROUND OF THE INVENTION

The present invention relates to a method of making rod-shaped smokers' products which are provided with so-called multiplex filter mouthpieces, namely, with filter mouthpieces which consist of several components or plugs each having a different filtering material for tobacco smoke. The invention also relates to filter cigarettes or analogous rod-shaped smokers' products which are produced in accordance with the method.

The demand for so-called "light" cigarettes, cigars and cigarillos (with low nicotine and tar content) is on the increase. Therefore, there exists an urgent need for filter mouthpieces which can effectively reduce the percentage of deleterious ingredients (or ingredients which are considered deleterious) from tobacco smoke which is drawn into a smoker's mouth. It has been found that filter mouthpieces which embody so called "NWA-filters" (namely, non-wrapped acetate filters wherein the filter material, such as acetate fibers, need not be provided with a discrete wrapper prior to attachment to a plain cigarette, cigar or cigarillo but comprises, instead, a reinforced porous peripheral layer) are highly satisfactory for use in light cigarettes. Moreover, "NWA-filters" can be produced at a reasonable cost.

Many manufacturers of smokers' products demand that the machines for the production of filter cigarettes or the like be further equipped with means for perforating the uniting bands which serve to connect the filter mouthpieces with tobacco rods. The perforations admit atmospheric air which is admixed to the column of tobacco smoke to reduce the percentage of nicotine and tar. Thus, there also exists an urgent need for filter mouthpieces whose constitutents can intercept a high percentage of deleterious ingredients of tobacco smoke, which dilute tobacco smoke by mixing the smoke with atmospheric air, and which can be produced and assembled with tobacco rods at a reasonable cost.

OBJECTS AND SUMMARY OF THE INVENTION

An object of the invention is to provide a novel and improved filter mouthpiece for cigarettes, cigars or cigarillos.

Another object of the invention is to provide a novel rod-shaped smokers' product (e.g., a filter cigarette) which embodies the improved filter mouthpiece.

An additional object of the invention is to provide a simple and inexpensive but effective filter mouthpiece which can intercept a high percentage of tar and nicotine.

Another object of the invention is to provide a filter mouthpiece which can effectively dilute and cool tobacco smoke.

A further object of the invention is to provide a novel and improved method of producing filter mouthpieces and rod-shaped smokers' products of the above outlined character.

An additional object of the invention is to provide a novel and improved method of assembling tobacco rods (such as plain cigarettes of unit length) with multiplex filter mouthpieces which are capable of intercepting deleterious ingredients of tobacco smoke and/or of diluting the smoke before it enters the smoker's mouth.

One feature of the invention resides in the provision of a method of making smokers' products (e.g., filter cigarettes of unit length of double unit length) of the type wherein a rod-like tobacco-containing section (e.g., a plain cigarette of unit length) is disposed end-to-end with a rod-like filter mouthpiece having several filter plugs which are disposed end-to-end and at least one of which consists of unwrapped filter material having a reinforced porous peripheral layer (i.e., at least one of which constitutes a so-called "NWA-filter"). The method comprises the steps of placing the filter mouthpiece and the tobacco-containing section end-to-end, and draping an adhesive-coated uniting band around the mouthpiece and that portion of the tobacco-containing section which is adjacent to the mouthpiece.

The method preferably further comprises the step of perforating a portion of the uniting band, and the draping step then includes convoluting the perforated portion of the uniting band around the one filter plug. The draped uniting band constitutes a tubular envelope which directly surrounds and contacts the reinforced porous peripheral layer of the one filter plug. The just mentioned method preferably further comprises the step of coating one side of the uniting band with a suitable adhesive prior to the perforating step, and the draping step then includes convoluting the uniting band around the filter mouthpiece and the tobacco-containing section in such a way that the adhesive-coated side of the uniting band is located at the inside of the resulting tubular envelope. The coating step is preferably carried out before a continuous web of suitable wrapping material (e.g., cigarette paper or imitation cork) is subdivided to yield a succession of discrete uniting bands, i.e., the adhesive can be applied to one side of the web, preferably in such a way that the web portions which are to be perforated are free of adhesive.

It is also possible to provide perforations in the convoluted uniting band, i.e., in the tubular envelope of a finished smokers' product. Such method includes the step of perforating that portion of the tubular envelope which surrounds the one filter plug, i.e., the reinforced porous peripheral layer of the one plug. The envelope can be perforated while the rod-shaped smokers' product is caused to roll about its own axis, and the perforating step may include piercing the envelope portion around the one filter plug by mechanical means (e.g., by a set of needles), by one or more beams of coherent radiation (preferably laser beams), or by electrical spark discharge. Similar devices can be employed for the making of holes in the web which is thereupon severed to yield discrete uniting bands.

The novel features which are considered as characteristic of the invention are set forth in particular in the appended claims. The machine itself, however, both as to its construction and its mode of operation, as well as the improved smokers' product, together with additional features and advantages of the method and product, will be best understood upon perusal of the following detailed description of certain specific embodiments with reference to the accompanying drawing.

DESCRIPTION OF THE PREFERRED EMBODIMENTS

Figure 1:
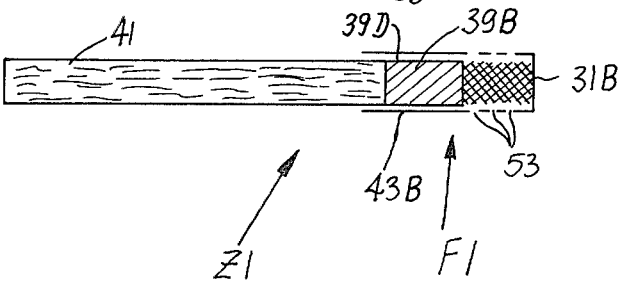
FIG. 1 is a schematic axial sectional view of a rod-shaped smokers' product which constitutes a filter cigarette of unit length and embodies one form of the invention.

FIG. 1 shows a filter cigarette Z1 which constitutes a rod-shaped smokers' product embodying one form of the invention. The cigarette Z1 comprises a first section (tobacco rod) which is a plain cigarette 41 of unit length, and a second section or filter mouthpiece F1 which includes two components or constituents, namely, two filter plugs 31B and 39B which are attached to the adjacent end portion of the plain cigarette 41 by a tubular envelope 43B consisting of one-half of a convoluted adhesive-coated uniting band 43A (see FIG. 3). One of the filter plugs (namely, the filter plug 31B which preferably consists of acetate fibers) has a reinforced peripheral layer which is porous (i.e., it is permeable to air). The plug 31B need not be surrounded by a tubular wrapper, i.e., by a wrapper which surrounds its filter material. The peripheral layer of the plug 31B is reinforced as a result of an appropriate chemical and/or thermal treatment. Such filter plugs are known as "NWA-filters". The envelope 43B is in direct contact with the reinforced porous peripheral layer of the filter plug 31B.

That portion of the envelope 43B which surrounds the plug 31B is formed with perforations or holes 53 which admit atmospheric air into the interior of the plug 31B whereby such air mixes with the column of tobacco smoke which flows toward the smoker's mouth when the exposed end portion of the plain cigarette 41 is lighted.

The plug 39B between the plug 31B and the plain cigarette 41 may be a conventional filter plug, e.g., a plug wherein a suitable filter material for tobacco smoke is surrounded by a tubular wrapper 39D consisting of paper or the like. For example, the filler of the plug 39B may consist of acetate fibers and it may further contain certain absorbent substances for tar, nicotine and/or other deleterious or presumably deleterious ingredients of tobacco smoke. The absorbent substance may be carbon in pulverulent or granular form.

The plug 39B which is shown in FIG. 1 can be replaced with a different filter plug, e.g., with a recessed filter plug or it may constitute a body of granular material (rather than fibers) which fills a chamber between the filter plug 31B and the adjacent end of the plain cigarette 41.

It is further within the purview of the invention to employ filter mouthpieces which consist of more than two sections or components, for example, of three different components. However, in each instance, at least one of the components is an "NWA-filter", and that portion of the envelope which surrounds the "NWA-filter" is preferably provided with perforations to admit atmospheric air into its interior by way of the reinforced permeable (porous) peripheral layer.

Figure 2:
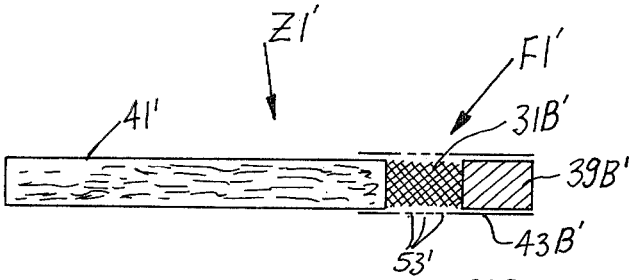
FIG. 2 is a similar schematic axial sectional view of a modified filter cigarette.

The filter cigarette Z1' of FIG. 2 differs from the cigarette Z1 in that the "NWA-filter" 31B' of the mouthpiece F1' is located between the plain cigarette 41' and the filter plug 39B' which latter corresponds to the filter plug 39B of FIG. 1. The envelope 43B' has perforations 53' which admit air into the interior of the "NWA-filter" 31B'.

Figure 3:
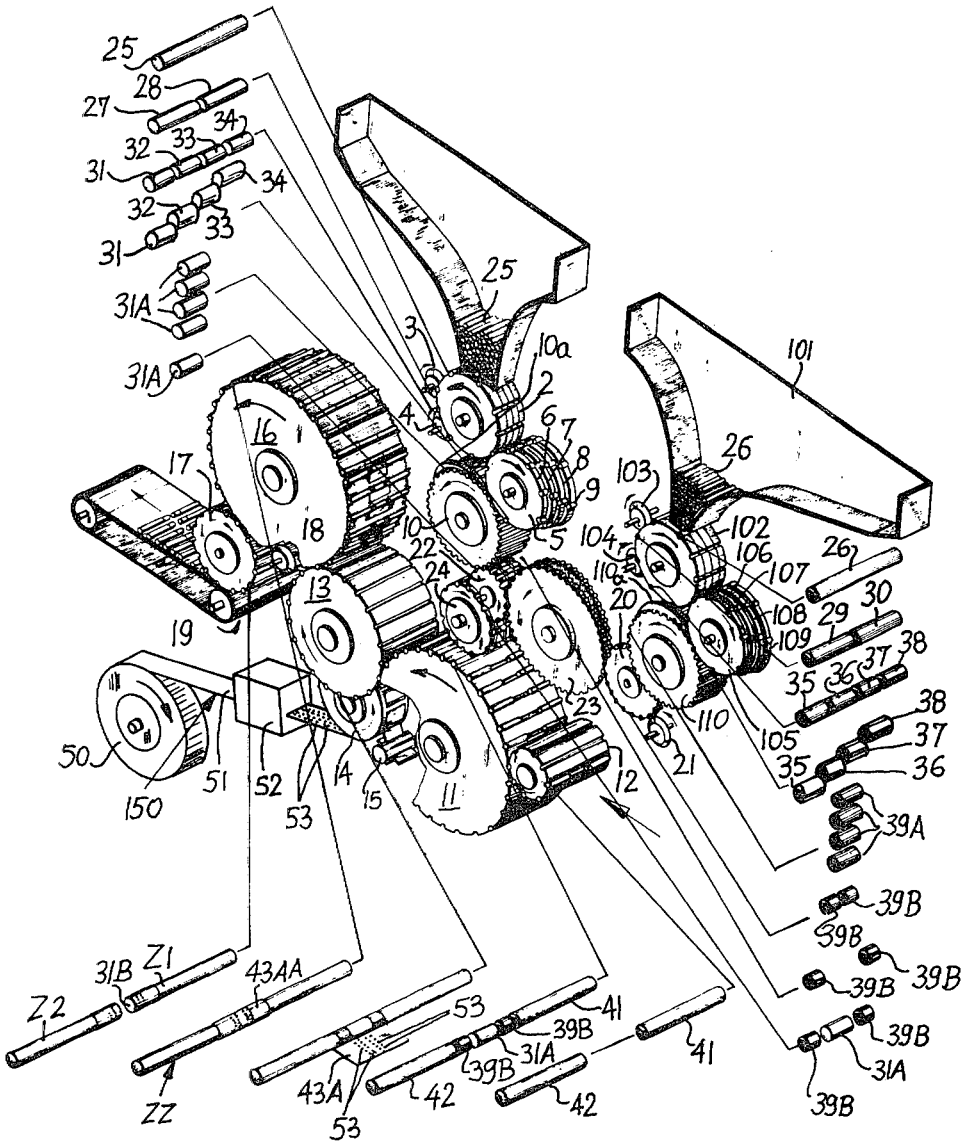
FIG. 3 is a perspective view of a machine for the making of filter cigarettes of the type shown in FIG. 1.

FIG. 3 shows a filter cigarette making machine which can be used for the production of filter cigarettes Z1. The machine comprises a magazine 1 for a supply of filter rod sections 25 of eight times unit length. The material of filter rod sections 25 is the same as that of the filter plug 31B or 31B', i.e., each section 25 can yield eight "NWA-filters" of unit length. The outlet of the magazine 1 supplies sections 25 into successive peripheral flutes of a rotary drum-shaped severing conveyor 2 which cooperates with a first rotary disk-shaped knife 3 to subdivide each section 25 into two shorter sections 27, 28 of four times unit length, and thereupon with two additional rotary disk-shaped knives 4 (only one can be seen in FIG. 3) which respectively subdivide the sections 27, 28 into pairs of sections 31, 32 and 33, 34 of double unit length. The sections 31, 32, 33 and 34 are respectively delivered into the peripheral flutes of a composite staggering conveyor 5 consisting of four disks 6, 7, 8 and 9 which rotate at different speeds and/or transport the respective sections 31, 32, 33 and 34 through different distances so that the sections 31–34 enter successive flutes of a rotary drum-shaped shuffling conveyor 10. The latter transports the sections 31–34 past one or more stationary cams **10*a* which cause some or all of the sections in the flutes of the shuffling conveyor 10 to move axially so that the shuffled sections 31–34 form a single row of aligned sections 31A** of double unit length.

In a conventional filter cigarette making machine, the sections 31A would be transferred into the flutes of a so-called accelerating conveyor which would insert each section 31A between two plain cigarettes of unit length in a flute of a so-called assembly conveyor which, in some respects, is a functional equivalent of the rotary drum-shaped assembly conveyor 11 shown in FIG. 3. The assembly conveyor 11 receives pairs of plain cigarettes 41, 42 of unit length from a transfer conveyor 12 whereby the spacing between the cigarettes 41, 42 of each pair suffices to provide room for insertion of a filter rod section 31A plus two filter plugs of unit length which flank the section 31A. The conveyor 12 can withdraw pairs of plain cigarettes of unit length from a suitable magazine (not shown) or directly from the discharge end of a maker of plain cigarettes. One or more intermediate conveyors can be interposed between the discharge end of the maker and the conveyor 12.

The assembly conveyor 11 delivers pairs of coaxial plain cigarettes 41, 42 of unit length, a filter rod section 31A plus two filter plugs of unit length to a transfer conveyor 13 which cooperates with a suction drum 14 serving to deliver adhesive-coated uniting bands 43A each of which is caused to adhere to the inner end portions of the respective plain cigarettes, to the section 31A and to the filter plugs of unit length (such filter plugs flank the section 31A and are adjacent to the inner ends of the respective plain cigarettes). The uniting bands 43A are obtained by severing the leader of a web 51 of wrapping material (e.g., cigarette paper or imitation cork) which is drawn off a roll 50 and passes through a perforating device 52. The means for severing the leader of the web 51 comprises a rotary knife 15 which cooperates with the suction drum 14. The perforating means of the device 52 provides the web 51 with four rows of perforations 53, two rows in each half of the web. The application of adhesive to one side of the web 51 can take place in the perforating device 52, between the roll 50 and the device 52, or between the device 52 and the suction drum 14. It is preferred to apply adhesive at a locus (indicated at 150) ahead of the perforating device 52 in order to make sure that the adhesive does not clog the perforations 53. The perforating device 52 can include mechanical perforating means (reference may be had to FIG. 2 of commonly owned copending application Ser. No. 841,108 filed Oct. 11, 1977 by Wahle et al.), means for generating sparks which burn holes in the web 51 (see FIG. 7 of the application of Wahle et al.), or a source of coherent radiation, e.g., one or more lasers, (reference may be had to commonly owned copending application Ser. No. 834,645 filed Sept. 19, 1977 by Heitmann et al.).

The transfer conveyor 13 transports the groups of plain cigarettes, filter rod sections and filter plugs past two leaf springs, stationary cams or disks whose axes are inclined with respect to the flutes of the conveyor 13 and which condense each group so as to insure that the end faces of each section 31A abut against the inner end faces of the respective filter plugs and the outer end faces of such filter plugs abut against the inner end faces of the respective plain cigarettes. The condensing of each group takes place prior to attachment of uniting bands 43A.

The flutes of the transfer conveyor 13 deliver condensed groups (each of which carries a uniting band 43A) onto a draping conveyor 16 whereon the components of the groups are caused to rotate about their respective axes so as to convert the uniting bands 43A into tubular envelopes 43AA of double unit length and to thus convert each group into a filter cigarette ZZ of double unit length. A rotary disk-shaped knife 18 severs each cigarette ZZ midway between its ends (i.e., across the center of the respective envelope 43AA) whereby each cigarette ZZ yields two filter cigarettes Z1, Z2 of unit length. Each such cigarette comprises one half (31B) of a section 31A, a filter plug 39B, a plain cigarette 41 or 42, and an envelope 43B with two rows of perforations 53 extending circumferentially around the filter plug 31B.

The knife 18 severs the cigarettes ZZ subsequent to their transfer into the flutes of a severing conveyor 17 which receives cigarettes ZZ from the draping conveyor 16. Pairs of coaxial filter cigarettes Z1, Z2 of unit length are delivered onto the upper reach of a take-off conveyor 19, e.g., an endless belt conveyor.

The apparatus of FIG. 3 further comprises an assembly conveyor 22 which assembles the sections 31A with pairs of filter plugs of unit length prior to transport of such sets of three coaxial rod-shaped articles each into the flutes of the assembly conveyor 11. The delivery of sets consisting of discrete filter rod sections 31A and pairs of filter plugs of unit length into the flutes of the assembly conveyor 11 is effected by an intermediate conveyor 24.

A second magazine 101 contains a supply of parallel filter rod sections 26 of eight times unit length, and its outlet admits such sections into the peripheral flutes of a severing conveyor 102 cooperating with a first rotary disk-shaped knife 103 to subdivide each section 26 into two shorter sections 29, 30. The sections 29, 30 are thereupon severed by rotary disk-shaped knives 104 (only one shown in FIG. 3) so that each thereof yields two coaxial filter rod sections (35, 36 and 37, 38) of double unit length. The severing conveyor 102 respectively delivers the sections 35–38 into the peripheral flutes of rotary disks 106, 107, 108, 109 which together constitute a shuffling conveyor 105. The disks 106–109 are driven at different speeds and/or transport the sections 35–38 through different distances so that such sections enter successive flutes of a rotary drum-shaped shuffling conveyor 110 which cooperates with one or more cams 110*a* to convert the sections 35–38 into a single row of aligned sections 39A. The material of the sections 39A is the same as that of the filter plug 39B shown in FIG. 1; each such section may comprise a filler consisting of acetate fibers and particles of absorbent material (e.g., charcoal), and a tubular wrapper 39D of paper or the like.

The shuffling conveyor 110 delivers successive sections 39A into successive flutes of a severing conveyor 20 which cooperates with a rotary disk-shaped knife 21 to sever the sections 39A so that each thereof yields two coaxial filter plugs 39B of unit length. The severing conveyor 20 delivers pairs of coaxial filter plugs 39B to a spreading conveyor 23 which comprises two mutually inclined rotary disks serving to move the plugs 39B of each pair apart so as to provide gaps which are wide enough to receive a filter rod section 31A of double unit length. The construction of the spreading conveyor 23 is known in the art of cigarette making. The conveyor 23 delivers pairs of spaced-apart plugs 39B into successive flutes of the assembly conveyor 22 so that each pair of plugs 39B flanks a section 31A in the respective flute. The assembly conveyor 22 delivers the thus obtained sets (each of which comprises a section 31A and two plugs 39B) into the flutes of the intermediate conveyor 24 which, in turn, delivers such sets into the flutes of the assembly conveyor 11, always into the gap between two coaxial plain cigarettes 41, 42 of unit length.

The operation of the filter cigarette making machine of FIG. 3 is as follows:

The magazine 1 admits filter rod sections ("NWA"-filters") 25 of eight times unit length into successive flutes of the severing conveyor 2 which cooperates with the rotary knives 3 and 4 to subdivide each section 25 into four coaxial sections 31–34 of double unit length. The manner in which the sections 25 are processed is shown in the upper left-hand portion of FIG. 3. The manner of processing the filter rod sections 26 is shown in the right-hand portion of FIG. 3, and the manner of processing plain cigarettes and sets of filter plugs and filter rod sections to form pairs of filter cigarettes Z1, Z2 is shown in the lower part of FIG. 3.

At the same time, the magazine 101 admits filter rod sections 26 of eight times unit length into successive flutes of the severing conveyor 102 which cooperates with the knives 103, 104 to subdivide each section 26 into four coaxial sections 35–38 of double unit length. The sections 31–34 and 35–38 are respectively delivered to the drums 6–9 and 106–109 of the staggering conveyors 5 and 105 which cooperate with the shuffling conveyors 10, 110 to form two rows of sections 31A, 39A (in the flutes of the conveyors 10, 110). The conveyor 10 delivers discrete sections 31A into successive flutes of the assembly conveyor 22, and the conveyor 110 delivers discrete sections 39A into successive flutes of the severing conveyor 20 which cooperates with the knife 21 to subdivide each section 39A into a pair of coaxial plugs 39B. The pairs of plugs 39B are delivered into the flutes of the assembly conveyor 22 by the spreading conveyor 23.

Successive sets of coaxial components 39B, 31A, 39B are delivered into the flutes of the assembly conveyor 11 by the flutes of the intermediate conveyor 24, and the groups in the flutes of the assembly conveyor 11 (each such group includes two plain cigarettes 41, 42, a section 31A and two plugs 39B) are condensed prior to transfer onto the conveyor 13 which advances the groups past the suction drum 14 which applies uniting bands 43A. The bands 43A are convoluted (on the conveyor 16) around the respective sections 31A, around the respective pairs of plugs 39B, and around the inner end portions of the respective plain cigarettes 41, 42 to form envelopes 43AA which form part of filter cigarettes ZZ of double unit length. Successive cigarettes ZZ are severed by the knife 18 during travel with the severing conveyor 17, and the thus obtained pairs of filter cigarettes Z1, Z2 of unit length are deposited onto the upper reach of the take-off conveyor 19.

If the filter rod sections 25 are admitted into the magazine 101, the ultimate products constitute filter cigarettes Z1′ of the type shown in FIG. 2, i.e., the filter plugs 31B′ are then located between the plain cigarettes 41′ and the filter plugs 39B′. The only modification which must be carried out if the magazines 1 and 101 respectively receive filter rod sections 26 and 25 is that the perforating unit 52 must be adjusted or replaced with a different perforating unit so as to insure that the two right-hand and the two left-hand rows of perforations 53 (see the lower part of FIG. 3) are more distant from each other (note that, in FIG. 2, the perforations 53′ are provided in that portion of the envelope 43B′ which surrounds the inner filter plug 31B′).

Figure 4:
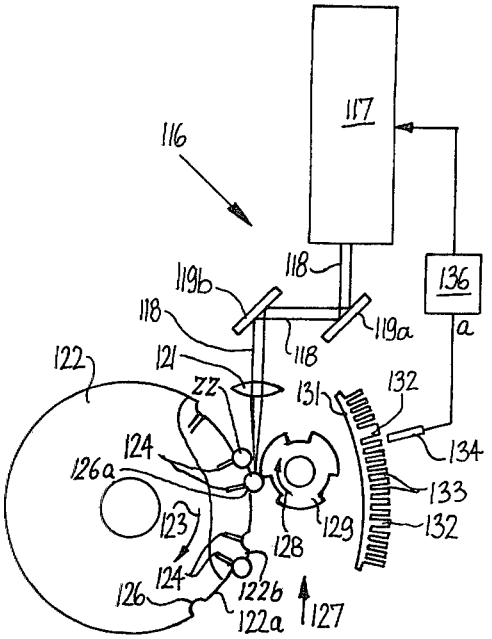
FIG. 4 is a fragmentary partly front elevational and partly schematic view of a modified filter cigarette making machine.

FIG. 4 shows a portion of a modified filter cigarette making machine. The difference is that the perforations in the envelopes of the filter cigarettes are formed subsequent to completion of filter cigarettes of unit length or double unit length. It is presently preferred to form the perforations in the envelopes corresponding to the envelopes 43AA of FIG. 3, i.e., prior to subdivision of a filter cigarette of double unit length into two coaxial filter cigarettes of unit length. This simplifies the construction of the perforating unit 116 of FIG. 4 and reduces its space requirements.

In FIG. 4, the conveyor 17 of FIG. 3 is replaced with a drum-shaped conveyor 122 whose peripheral surface has convex rolling portions or facets **122*a* separated from each other by projections or ridges 122*b*. The conveyor 122 is driven to rotate in a clockwise direction, as viewed in FIG. 4 (see the arrow 123). Each facet 122*a* has two flutes 126, 126*a* which are adjacent to the neighboring ridges 122*b*, and each flute communicates with suction ports 124 which are machined into the body of the conveyor 122 and are connected to a suction generating device during certain stages of each revolution of the conveyor 122**.

A rolling device 127 with several lobes 129 is adjacent to the conveyor 122 and is driven to rotate in the direction indicated by the arrow 128. The purpose of the lobes 129 is to roll successive filter cigarettes ZZ of double unit length about their respective axes in such a way that each cigarette advances from the flute 126 into the flute **126*a* of the respective facet 122*a* during travel past the rolling device 127. Actually, a cigarette ZZ which is rolled by a lobe 129 is at a standstill while the respective facet 122*a* moves therealong in the direction of arrow 123. The filter cigarettes ZZ roll backwards, i.e., counterclockwise, as viewed in FIG. 4, and such rolling results in exposure of successive portions of their envelopes 43AA to laser beams 118 which are focussed by optical means 121. The perforating unit 116 of FIG. 4 further comprises at least one laser 117 whose beam or beams 118 are deflected by mirrors 119*a*, 119*b* before they reach the focusing means 121. The laser 117 is activated by a pulse generator circuit 136 whose input a receives impulses from a proximity detector 134 adjacent to the teeth 133 of a wheel 131 which rotates in synchronism with the rolling device 127. The projections 132 which separate successive groups of projections 133 interrupt the actuation of the laser 117 during travel of ridges 122*b* past the locus of focusing of laser beams 118 upon successive envelopes 43AA. The beams 118 provide the envelopes 43AA with at least two rows of perforations (see the perforations 53 in FIG. 3) which are provided in those portions of the envelope 43AA that surround the respective "NWA-filters". The beams 118 which impinge upon the envelopes 43AA can be obtained by splitting a single laser beam, or the perforating unit 116 comprises several lasers disposed one behind the other, as considered in the axial direction of filter cigarettes ZZ on the conveyor 122. The manner of perforating the envelopes by laser beams is fully disclosed in the aforementioned copending application Ser. No. 834,645 of Heitmann et al. Reference may be had to this copending application for further details of the perforating unit 116. As mentioned above, the copending application of Wahle et al. further discloses a perforating unit which burns holes in a web of coherent uniting bands by spark discharge; such perforating units, too, can be used in the machine of FIG. 3**.

An important advantage of the improved method is that the sets of filter plugs can be assembled in a simple and effective way by resorting to relatively simple apparatus. Furthermore, the filtering action of the improved mouthpieces is highly satisfactory in spite of their relatively low cost. Still further, such filtering action can be enhanced by the provision of so-called aerating zones (i.e., those portions of tubular envelopes which are formed with perforations) which allow atmospheric air to enter the mouthpieces and to be admixed to the column of tobacco smoke. Reduced cost of the improved mouthpieces is attributable, at least to a certain degree, to the fact that the filter rods 25 need not be wrapped in paper or the like, i.e., that the material of the filter itself forms an integral wrapper which is porous so as to enable atmospheric air to reach the column of tobacco smoke.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. A smokers' product, particularly a filter cigarette, comprising coaxial first and second rod-like sections one of which includes a tobacco filler and a tubular wrapper surrounding said filler, the other of said sections comprising a plurality of coaxial filter plugs at least one of which comprises an unwrapped rod consisting of filter material and having a reinforced porous peripheral layer; and a tubular envelope surrounding said other section and that portion of said one section which is adjacent to said other section, said envelope having a perforated portion surrounding said one filter plug.

2. A product as defined in claim 1, wherein said other section comprises a plurality of filter plugs which comprise unwrapped rods consisting of filter material and having reinforced porous peripheral layers.

3. A product as defined in claim 1, wherein another of said filter plugs comprises a tubular wrapper which is surrounded by said envelope.

4. A product as defined in claim 3, wherein said other filter plug further comprises a filler which is surrounded by said wrapper and includes absorbent material.

5. A product as defined in claim 4, wherein said absorbent material is carbon in pulverulent or granular form.

6. A method of making smokers' products of the type wherein a rod-like tobacco-containing section is disposed end-to-end with a rod-like filter mouthpiece having several filter plugs which are disposed end-to-end and at least one of which consists of unwrapped filter material having a reinforced porous peripheral layer, comprising the steps of placing the mouthpiece and the section end-to-end; perforating a portion of an adhesive-coated uniting band; and draping said uniting band around the mouthpiece and around that portion of the section which is adjacent to the mouthpiece, including convoluting the perforated portion of the uniting band around the one filter plug.

7. A method as defined in claim 6, further comprising the step of coating one side of the uniting band with adhesive prior to said perforating step, said draping step including convoluting the band around the mouthpiece and around the adjacent portion of the tobacco-containing section in such a way that the adhesive-coated side of the uniting band is located at the inside of the resulting tubular envelope.

8. A method as defined in claim 6, further comprising the step of coating one side of the uniting band, with the exception of said portion of the uniting band, with an adhesive.

9. A method of making smokers' products of the type wherein a rod-like tobacco-containing section is disposed end-to-end with a rod-like filter mouthpiece having several filter plugs which are disposed end-to-end and at least one of which consists of unwrapped filter material having a reinforced porous peripheral layer, comprising the steps of placing the mouthpiece and the section end-to-end; draping an adhesive-coated uniting band around the mouthpiece and around that portion of the section which is adjacent to the mouthpiece; and perforating that portion of the draped uniting band which surrounds the one filter plug.

10. A method as defined in claim 9, wherein said perforating step includes rolling the product about its axis and piercing said portion of the draped uniting band.

11. A method of making smokers' products of the type wherein a rod-like tobacco-containing section is disposed end-to-end with a rod-like filter mouthpiece having several filter plugs which are disposed end-to-end and at least one of which consists of unwrapped filter material having a reinforced porous peripheral layer, comprising the steps of placing the mouthpiece and the section end-to-end; draping an adhesive-coated uniting band around the mouthpiece and around that portion of the section which is adjacent to the mouthpiece; and perforating that portion of the draped uniting band which surrounds the one filter plug, including rolling the product about its own axis and intermittently directing at least one beam of coherent radiation against said portion of the draped uniting band.

12. A method as defined in claim 11, wherein said beam is a laser beam.

13. A smokers' product, particularly a filter cigarette, comprising coaxial first and second rod-like sections one of which includes a tobacco filler and a tubular wrapper surrounding said filler, the other of said sections comprising a plurality of coaxial filter plugs each consisting at least in part of a filter material other than tobacco and at least one of which comprises an unwrapped rod having a reinforced porous peripheral layer; and a tubular envelope surrounding said other section and that portion of said one section which is adjacent to said other section.

14. A method of making smokers' products of the type wherein a rod-like tobacco-containing section is disposed end-to-end with a rod-like filter mouthpiece having several filter plugs each of which consists at least in part of a filter material other than tobacco, which are disposed end-to-end and at least one of which consists of unwrapped filter material having a reinforced porous peripheral layer, comprising the steps of placing the mouthpiece and the section end-to-end; and draping an adhesive-coated uniting band around the mouthpiece and around that portion of the section which is adjacent to the mouthpiece.

* * * * *